United States Patent [19]

Troupel et al.

[11] Patent Number: 4,988,416

[45] Date of Patent: Jan. 29, 1991

[54] PROCESS FOR THE ELECTROSYNTHESIS OF ALDEHYDES

[75] Inventors: Michel Troupel, Maincy; Soline Sibille, Saint-Maur des Fosses; Jacques Perichon, Savigny sur Orge; Esther D'Incan, Chatenay-Malabry; Christhophe Saboureau, Brie-Comte - Robert, all of France

[73] Assignee: Societe Nationale des Poudres et Explosifs, Paris, France

[21] Appl. No.: 437,820

[22] Filed: Nov. 17, 1989

[30] Foreign Application Priority Data

Nov. 23, 1988 [FR] France ..... 88 15235

[51] Int. Cl.[5] ..... C25B 3/00

[52] U.S. Cl. ..... 204/59 R

[58] Field of Search ..... 204/59 R, 72, 78, 79, 204/80

[56] References Cited

U.S. PATENT DOCUMENTS 4,547,271 10/1985 Bharucha et al. ..... 204/78
4,582,577 4/1986 Wagenknecht ..... 204/59 R
4,601,797 7/1986 Wagenknecht ..... 204/59 R
4,629,541 12/1986 Moingeon et al. ..... 204/59 R
4,637,863 1/1987 Perichon et al. ..... 204/59 R
4,686,018 8/1987 Chaussard ..... 204/59 R

*Primary Examiner*—John F. Niebling
*Assistant Examiner*—Steven P. Marquis
*Attorney, Agent, or Firm*—Burns, Doane, Swecker & Mathis

[57] ABSTRACT

The process for the electrosynthesis of an aldehyde, according to the invention, is carried out by electrolysis, in a cell comprising only a single compartment, of an organic halide and of an N,N-disubstituted formamide such as dimethylformamide, followed by hydrolysis of the reaction mixture.

The anode is made of a metal chosen from the group consisting of the reducing metals and their alloys, preferably zinc, aluminum or magnesium.

The cathode, which is inert, is preferably covered with an electrolytic deposit of zinc, cadmium, lead or tin.

Aldehydes are compounds which are commonly employed in many fields of the chemical industry, especially in perfumery, agricultural chemistry and pharmacy.

20 Claims, No Drawings

PROCESS FOR THE ELECTROSYNTHESIS OF ALDEHYDES

The invention relates to a process for the electrochemical synthesis of an aldehyde by electrolysis of an organic halide and of an N,N-disubstituted formamide in a cell fitted with electrodes, followed by hydrolysis of the reaction mixture.

Aldehydes are compounds which are commonly employed in many fields of the chemical industry, especially in perfumery, in agricultural chemistry and in pharmacy.

There are very many processes for the synthesis of aldehydes. Among these, there may be mentioned those in which the aldehyde is obtained by electrolysis, in a cell fitted with electrodes, of an organic halide and of an N,N-disubstituted formamide, followed by hydrolysis of the reaction mixture.

Casardo and Gallardo, Electrochimica Acta, vol. 32, No. 8, pp. 1145–1147, (1987), describe the synthesis of traces of benzaldehyde during the electrolysis of solutions of bromo- or of iodobenzene in dimethylformamide (DMF). The cell comprises 2 separate anode and cathode compartments. The cathode is of mercury and the anode, which is inert, is made of graphite.

Vieira and Peters, J. Org. Chem., vol. 51, No. 8, pp. 1231–1239, (1986), describe the synthesis of pivalaldehyde during the electrolysis of a solution of tertbutyl bromide in DMF. The yields are very low, below 14%. The cell comprises 2 separate anode and cathode compartments. The cathode is of mercury and the anode, which is inert, is made of carbon.

The authors also teach that they have not been able to obtain the formation of aldehydes from primary or secondary alkyl halides under the same conditions.

The Applicant Company has found that, quite unexpectedly, good yields were obtained, even from primary or secondary alkyl halides, when the cell comprises only a single compartment and when a sacrificial anode is employed, made of a metal chosen from the group consisting of the reducing metals and their alloys.

When compared with the abovementioned most closely related state of the art, the process according to the invention offers, in addition to a considerable improvement in the yield and a broadening of the field of application, a certain number of other advantages, the main ones of which are:

- a simpler implementation, since the process is carried out in an electrolysis cell comprising only a single compartment, without diaphragm or sinter, and this is very important on an industrial scale,
- a very markedly higher halide concentration,
- a higher current intensity, of the order of several amperes per $dm^2$,
- the possibility of employing a very low concentration of supporting electrolyte, of the order of $10^{-2}$M, and
- the use of solid electrodes limiting the risks of contamination with heavy metals such as mercury.

The electrolysis cell is a cell comprising only a single compartment, that is to say in which there are no separate anode and cathode compartments. This possibility of employing a cell of this kind is an important advantage, as has already been mentioned.

The anode is sacrificial, that is to say that it is consumed during the electrochemical reaction of which it is the site. This is the reason why such processes are sometimes called "with a soluble anode". The anode is made of a metal chosen from the group consisting of the reducing metals and their alloys, that is to say any alloy containing at least one reducing metal.

The anode is preferably made of a reducing metal chosen from the group consisting of magnesium, aluminium, zinc and their alloys, that is to say any alloy containing at least one of the three above mentioned metals, namely zinc, aluminium and magnesium. This anode may take any shape and especially all the traditional shapes of metal electrodes such as, for example, twisted wire, flat bar, cylindrical bar, renewable bed, beads, cloth or grid. A cylindrical bar of a diameter adapted to the cell dimensions is preferably employed.

The cathode is made of any metal such as stainless steel, gold, nickel, platinum, copper, aluminium, iron or carbon such as, for example, vitreous carbon or graphite. It preferably consists of a grid or a cylindrical plate arranged concentrically around the anode.

The Applicant Company has found that, unexpectedly, the yield was considerably improved when the cathode is covered with an electrolytic deposit of a metal M chosen from the group consisting of zinc, cadmium, lead and tin.

The electrodeposition of the metal M on the cathode, before the electrosynthesis of the aldehyde, may be carried out according to various methods, especially those described in Examples 14 to 38.

The electrodes are fed with direct current by means of a stabilized supply.

According to the invention, the aldehyde preferably corresponds to the general formula RCHO in which R denotes an organic radical, the organic halide corresponds to the general formula RX in which R has the abovementioned meaning and X denotes a halogen atom, preferably chlorine or bromine, and the N,N-disubstituted

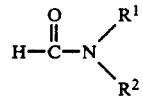

in which $R^1$ and $R^2$, which are identical or different, denote a substituted or unsubstituted aliphatic or aromatic chain, preferably either an alkyl chain containing 1 to 8 carbon atoms or a substituted or unsubstituted phenyl ring, or else $R^1$ and $R^2$ form a ring.

R preferably denotes a substituted or unsubstituted, aliphatic, arylaliphatic, aromatic, alkylaromatic or heterocyclic organic radical, preferably an alkyl radical or a phenyl group, substituted or unsubstituted. Quite obviously, when R carries various substituents, the latter must be more difficult to reduce than the R—X bond.

In a particularly preferred manner, the formamide is DMF. N,N-Dialkylformamides and N-phenyl-N-methylformamide (N-methylformanilide) may be mentioned as examples of other formamides.

It is also possible to use a mixture of several formamides corresponding to the abovementioned general formula.

The process forming the subject matter of the present invention may be represented by the following reaction scheme:

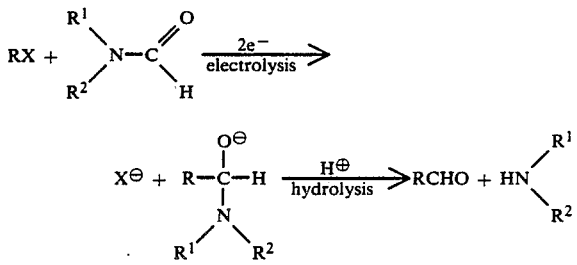

in which R, $R^1$ and $R^2$ have the abovementioned meaning.

The hydrolysis of the reaction mixture is carried out using, for example, an acidic aqueous solution.

In addition to acting as a reactant, the N,N-disubstituted formamide also preferably acts as a solvent within the scope of the present invention. This is especially the case when DMF is employed. It is then unnecessary to employ another solvent. However, the electrolysis can be carried out in the presence of a cosolvent chosen from weakly electrophilic aprotic solvents such as, for example, tetramethylurea (TMU) and tetrahydrofuran (THF).

When the N,N-disubstituted formamide is present in the conditions of the electrosynthesis in a physical state such that is can no longer act suitably as a solvent, the presence of a weakly electrophilic aprotic solvent of this kind is then recommended.

The reactant concentration is preferably chosen so as to ensure a very large molar excess of formamide, since the latter also preferably acts as the solvent.

The concentration of the organic halide in the reaction mixture is generally between 0.05 and 2 mol/l.

The reaction mixture is made conductive by a poorly reducible supporting electrolyte. Salts which may be mentioned, for example, are those in which the anion is a halide, a carboxylate, a fluoroborate, a perchlorate or a hexafluorophosphate, and the cation a quaternary ammonium, aluminium, zinc, sodium, potassium, calcium, lithium or tetraalkylphosphonium, as well as mixtures of these salts. Tetramethylammonium fluoroborate or tetrabutylammonium bromide is preferably employed.

Before the electrolysis the solution is deoxygenated by bubbling through an inert gas, for example nitrogen or argon.

The reaction temperature is preferably between 0 and 80° C., for example the ambient temperature.

Throughout the electrolysis period the solution is stirred, kept under an inert atmosphere, for example of nitrogen or argon, and is cooled if necessary to keep its temperature preferably between 0 and 80° C.

The cathode current density is preferably chosen between 0.2 and 20 A/dm$^2$.

The operation is generally carried out at constant intensity, but it is also possible to operate at constant voltage, at controlled potential, or with variable intensity and potential.

The electrolysis period is preferably chosen so that the quantity of current employed corresponds to approximately 2 faradays ($193\times10^3$C) per mole of organic halide.

The change in the concentration of organic halide may also be followed by analysis of aliquot samples and the electrolysis may be stopped as soon as the desired degree of conversion is reached.

After electrolysis, the reaction medium is hydrolysed with an acidic aqueous solution, for example dilute hydrochloric acid, and it is then extracted with an organic solvent. After drying and evaporating down the extraction solvent, the aldehyde is obtained and is identified and determined using conventional methods of analysis, after an optional purification, for example by passing through a silica column.

In the particular case where the cathode employed is covered with an electrolytic deposit of a metal M such as defined above and when M denotes cadmium lead or tin, the metal M to be deposited onto the cathode may be introduced directly in the form of a salt, for example cadmium bromide, lead acetate or tin chloride, into the mixture of organic halide and N,N-disubstituted formamide. At the beginning of electrolysis the metal M is deposited onto the cathode. A lower current intensity may be employed at the beginning of electrolysis in order to improve the adhesion and the quality of the deposit.

When the organic halide is highly reactive, which is the case, for example, with allyl or benzyl halides, the yield is improved by adding the organic halide progressively into the reaction mixture during electrolysis.

The invention is illustrated by the examples which are to follow, no limitation being implied.

A conventional electrolysis cell comprising only a single compartment is employed to produce these examples.

The upper part of the cell is made of glass and is equipped with 5 tubes, including a central one permitting the delivery and the outflow of argon employed as inert gas, the optional sampling of solution during electrolysis, the addition of reactants and the electrical connections.

The lower part consists of a plug fitted with a seal, screwed onto the glass upper part.

The total cell capacity is in the neighborhood of 45 cm$^3$ and its working capacity in the neighborhood of 35 cm$^3$.

The anode is a cylindrical bar with a diameter in the neighborhood of 1 cm, made of zinc, magnesium or aluminium, depending on the tests. It is introduced into the cell through the central tube and is thus situated approximately in an axial position relative to the cell.

The cathode consists of a cylindrical metal grid arranged concentrically around the anode. The working surface area of the cathode is of the order of 20 cm$^2$.

The cell is immersed in a thermostat bath controlled at the chosen temperature.

During the electrolysis the reaction mixture is stirred, for example using a bar magnet.

EXAMPLES 1 to 12

The solution to be electrolysed, consisting of the following, is introduced into the cell:

- the organic halide,
- the N,N-disubstituted formamide or the mixture of N,N-disubstituted formamides,
- optionally, the cosolvent,
- the supporting electrolyte, tetramethylammonium fluoroborate at a concentration of $5\times10^{-3}$ M except for Example 7, in the case of which the supporting electrolyte is tetrabutylammonium bromide at a concentration of $10^{-2}$ M.

This mixture is degassed by bubbling through argon, and it is then maintained under an argon atmosphere.

After electrolysis at constant intensity for a period corresponding to 3 faradays ($290\times10^3$C) per mole of organic halide, the reaction mixture is hydrolysed with a 1 N aqueous solution of hydrochloric acid, and is then extracted with diethyl ether.

The organic phase is then separated off and washed with water.

After drying and evaporating off the solvents, the aldehyde obtained is purified by chromatography on a silica column and is then identified using conventional methods of analysis, especially by infrared (IR), mass (MS) and nuclear magnetic resonance (NMR) spectrometry.

The identity of the starting organic halide, that of the aldehyde formed and the corresponding mass yield of isolated pure aldehyde are shown in Table 1 for each example.

The concentration of organic halide is 0.5 M in the case of Examples 1, 3 to 9 and 12, and 0.125 M in the case of Example 2.

In the case of Examples 10 and 11 $CF_3Br$, being a gas, is introduced by bubbling into the reaction mixture at a pressure of $10^5$ Pa (1 bar).

The cathode is made of nickel in the case of Examples 10 and 11, of stainless steel in the case of Examples 1 to 6, 8 and 9 to 12, and of lead in the case of Example 7.

The anode is made of zinc in the case of Example 10 and of aluminium in the case of Examples 1 to 4, 6 to 9 and 12.

The volume of formamide or of the mixture of formamides is 36 $cm^3$. This volume includes the cosolvent when the latter is present.

The formamide is DMF in the case of Examples 1 to 5 and 7 to 12, and a 1/1 mixture by volume of DMF and N-methylformanilide in the case of Example 6.

Examples 2 and 4 are carried out in the presence of a cosolvent. In the case of Example 2 the cosolvent is THF and the DMF/THF volume ratio is correspondingly 2/1. In the case of Example 4 the cosolvent is TMU and the DMF/TMU volume ratio is correspondingly 1/1.

The cathode current density is 2 $A/dm^2$ in the case of Examples 1, 2 and 7 to 11, 1.5 $A/dm^2$ in the case of Example 12, 1 $A/dm^2$ in the case of Examples 3 and 4 and 0.5 $A/dm^2$ in the case of Examples 5 and 6.

The reaction temperature is 25° C. in the case of Examples 1 to 9 and 0° C. in the case of Examples 10 to 12.

In the case of Examples 10 and 11, trifluoroacetaldehyde is isolated in hydrate form and the yield shown in Table 1 is a Faraday yield calculated from the quantity of electricity used.

TABLE 1

| Ex. | Organic halide | Aldehyde formed | Yield (%) |
|---|---|---|---|
| 1 | | | 30 |
| 2 | 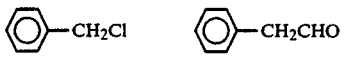 | | 30 |
| 3 | | | 35 |
| 4 | 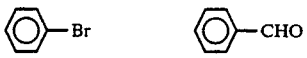 | | 25 |
| 5 | | | 30 |
| 6 | | | 20 |
| 7 | | | 16 |

TABLE 1-continued

| Ex. | Organic halide | Aldehyde formed | Yield (%) |
|---|---|---|---|
| 8 | 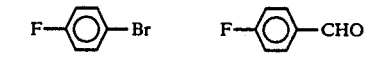 | | 25 |
| 9 | 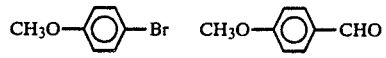 | | 20 |
| 10 | $CF_3Br$ | $CF_3CHO$ | 25 |
| 11 | | | 75 |
| 12 | $CH_3(CH_2)_7Br$ | $CH_3(CH_2)_7CHO$ | 25 |

Example 13

In this example, the experimental conditions are the same as those of Example 1, but the initial concentration of benzyl chloride is 0.125 M. After electrolysis corresponding to the passage of 2 faradays ($193\times10^3$ C) per mole of benzyl chloride, a quantity of benzyl chloride equal to that present at the outset is added. The electrolysis is then continued until its total duration corresponds to 3 faradays ($290\times10^3$ C) per mole of benzyl chloride introduced. The yield of isolated pure aldehyde is 50%.

Examples 14 to 38

In the case of these examples the cathode, made of stainless steel or nickel, is covered with an electrolytic deposit of a metal M.

The electrodeposition of the metal M onto the cathode, preceding the electrosynthesis of the aldehyde, was carried out by a number of methods:

Method A:

$MBr_2$ at a concentration of the order of $5\times10^{-2}$ M to $10^{-1}$ M is added to the DMF containing tetrabutylammonium bromide as a supporting electrolyte at a concentration of $10^{-2}$ M. The cell is equipped with an anode made of metal M and a current of 0.1 to 0.2 A is applied for 0.5 to 1 h, which makes it possible to ensure the transport of M from the anode towards the cathode.

The anode M is then replaced by a bar of magnesium and the electrolysis is continued at constant intensity for the time necessary to exhaust almost completely the $M^{2+}$ ions present in the solution. The organic halide is then added to this solution.

Method B:

$MBr_2$ at a concentration of the order of $5\times10^{-2}$ M to $10^{-1}$ M is added to the DMF containing tetrabutylammonium bromide as supporting electrolyte at a concentration of $10^{-2}$ M. The cell is fitted with a magnesium anode and a current of 0.1 to 0.2 A is applied for the time needed for the electrodeposition of the $M^{2+}$ ions onto the cathode. The organic halide is then added.

Method C:

When M is cadmium, lead or tin, the operation can be carried out in a single stage. $CdBr_2$, $Pb(CH_3CO_2)_2$ or $SnCl_2$, at a concentration of the order of $5\times10^{-2}$ to $10^{-1}$ M, and to the organic halide are added to the DMF containing tetrabutylammonium bromide as supporting electrolyte at a concentration of $10^{-2}$ M.

The cell is fitted with a magnesium anode and a constant intensity current is applied.

The electrodeposition of cadmium, lead or tin onto the cathode precedes the electrosynthesis of the aldehyde.

Method D:

The cathode, coated according to one of the above-mentioned methods A, B or C and then used for the electrosynthesis of an aldehyde according to the invention is reused without modification in a new electrosynthesis of aldehyde with a magnesium anode, in a DMF medium containing tetrabutylammonium bromide at a concentration of $10^{-2}$ M as supporting electrolyte.

In the case of all these examples I4 to 38 the electrosynthesis is conducted at ambient temperature, the constant current intensity applied being such as to make the cathode current density 1 A/dm$^2$.

The electrolysis period is chosen so as to employ 2.1 faradays ($203\times10^3$ C) per mole of organic halide.

Before the electrolysis the reaction mixture is degassed by bubbling through argon and the mixture is then kept under an argon atmosphere.

After the electrolysis the mixture is hydrolysed and the aldehyde formed is then isolated, purified, identified and determined using the method described in the case of Examples 1 to 14.

In the case of Example 37 the aldehyde is recovered in hydrate form.

The unreacted organic halide and the aldehyde formed can also be determined by gas phase chromatography (GC) from a sample of an aliquot portion of the solution after acidic hydrolysis (6 N HCl) and extraction with diethyl ether. The determination of the unreacted organic halide enables the degree of conversion of this halide to be calculated.

Table 2, which follows, gives, in the case of each example, the identity and the concentration of the organic halide in DMF, the nature of the cathode, and the method employed for electrodeposition of the metal M.

Table 3, which follows, gives, in the case of each example, the degree of conversion of the organic halide and the identity and the yield of the aldehyde formed, in relation to the starting organic halide. In the case of some examples the yield of isolated pure aldehyde is also shown in brackets.

TABLE 2

| Ex. | Organic halide: Identity | Organic halide: Concentration in mol/l | Cathode: Support/M | Cathode: Method |
|---|---|---|---|---|
| 14 | 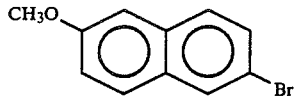 | 0.30 | Stainless/Cd | C |
| 15 | p-$FC_6H_4Br$ | 0.30 | Stainless/Cd | C |
| 16 | $C_6H_5Br$ | 0.41 | Nickel/Zn | B |
| 17 | $C_6H_5Br$ | 0.86 | Nickel/Zn | B |
| 18 | $C_6H_5Br$ | 0.30 | Stainless/Zn | A |
| 19 | p-$CF_3$—$C_6H_4Cl$ | 0.30 | Stainless/Zn | A |
| 20 | m-$CH_3$—$C_6H_4Cl$ | 0.50 | Stainless/Zn | A |
| 21 | $C_6H_5CH_2Cl$ | 0.35 | Stainless/Zn | A |
| 22 | p-$CF_3$—$C_6H_4Cl$ | 0.41 | Stainless/Zn | B |
| 23 | p-$CF_3$—$C_6H_4Cl$ | 0.65 | Stainless/Cd | A |
| 24 | p-$CF_3$—$C_6H_4Cl$ | 0.55 | Stainless/Cd | C |
| 25 | p-$CF_3$—$C_6H_4Cl$ | 0.65 | Stainless/Cd | D |
| 26 | p-$CF_3$—$C_6H_4Cl$ | 0.40 | Stainless/Cd | D |
| 27 | p-$CF_3$—$C_6H_4Cl$ | 0.63 | Stainless/Cd | D |
| 28 | p-$CF_3$—$C_6H_4Cl$ | 0.70 | Stainless/Cd | D |
| 29 | p-$CF_3$—$C_6H_4Cl$ | 0.51 | Stainless/Cd | D |
| 30 | $C_6H_5CH_2Cl$ | 0.30 | Stainless/Cd | A |
| 31 | p-$CH_3O$—$C_6H_4Br$ | 0.40 | Stainless/Cd | C |
| 32 | 1,2,4—$C_6H_3Cl_3$ | 0.40 | Stainless/Cd | C |
| 33 | 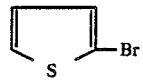 | 0.60 | Stainless/Cd | C |
| 34 | $C_6H_5I$ | 0.50 | Stainless/Cd | C |
| 35 | $C_6H_5Br$ | 0.50 | Stainless/Pb | C |
| 36 | $C_6H_5CH{=}CHBr$ | 0.30 | Stainless/Cd | C |
| 37 | $C_6H_5CF_3$ | 0.30 | Stainless/Cd | C |
| 38 | p-$CF_3C_6H_4Cl$ | 0.50 | Stainless/Sn | C |

TABLE 3

| Ex. | Degree of conversion of the halide (%) | Aldehyde formed | Yield (%) |
|---|---|---|---|
| 14 | 80 | 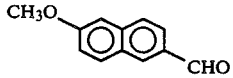 | 20 |
| 15 | 90 | p-$FC_6H_4CHO$ | 47 |
| 16 | 100 | $C_6H_5CHO$ | 58 |
| 17 | 100 | $C_6H_5CHO$ | 60 |
| 18 | 100 | $C_6H_5CHO$ | 66 |
| 19 | 100 | p-$CF_3$—$C_6H_4CHO$ | 70 (55) |
| 20 | 100 | m-$CH_3$—$C_6H_4CHO$ | 35 |
| 21 | 100 | $C_6H_5CH_2CHO$ | 67 |
| 22 | 95 | p-$CF_3$—$C_6H_4CHO$ | 68 |
| 23 | 100 | p-$CF_3$—$C_6H_4CHO$ | 70 (60) |
| 24 | 100 | p-$CF_3$—$C_6H_4CHO$ | 71 |
| 25 | 95 | p-$CF_3$—$C_6H_4CHO$ | 72 |
| 26 | 100 | p-$CF_3$—$C_6H_4CHO$ | 77 |
| 27 | 97 | p-$CF_3$—$C_6H_4CHO$ | 78 |
| 28 | 100 | p-$CF_3$—$C_6H_4CHO$ | 80 |
| 29 | 100 | p-$CF_3$—$C_6H_4CHO$ | 90 |
| 30 | 100 | $C_6H_5CH_2CHO$ | 47 |
| 31 | 100 | p—$CH_3O$—$C_6H_4CHO$ | 69 (56) |
| 32 | 100 | 2,5-dichlorobenzaldehyde | 50 |
| 33 | 100 | 2-thiophenecarboxaldehyde | 65 |
| 34 | 100 | $C_6H_5CHO$ | 60 |
| 35 | 100 | $C_6H_5CHO$ | 80 |
| 36 | 90 | $C_6H_5CH{=}CH{-}CHO$ | 16 |
| 37 | 95 | $C_6H_5CF_2CHO$ | 50 |
| 38 | 98 | p-$CF_3C_6H_4CHO$ | 85 |

Example 39

The operation is carried out using the general conditions relating to Examples 14 to 38, but:

the cathode current density is 0.1 A/dm$^2$, a stainless steel cathode is employed, coated with an electrolytic deposit of cadmium using method D, the reaction medium is a 75/25 volume mixture of N-methylformanilide and TMU respectively, containing tetrabutylammonium bromide as supporting electrolyte at a concentration of $10^{-2}$ M and p-$CF_3C_6H_4Cl$ as organic halide at a concentration of 0.50 mol/l.

The degree of conversion of the organic halide is 100% p-$CF_3C_6H_4CHO$ is obtained in a 15% yield.

Example 40

After degassing by bubbling through argon and keeping the cell under an argon atmosphere, a solution of 9 g of para-chlorotrifluorotoluene, 200 mg of tetrabutylammonium bromide and 500 mg of anhydrous cadmium bromide in 35 ml of DMF is electrolysed for 1 h at a current intensity of 0.1 A and then for 5 h and 30 min at a current intensity of 0.5 A while the temperature of the reaction mixture is kept at approximately 40° C.

The anode is made of magnesium and the cathode of stainless steel.

The reaction mixture is then treated as in the case of Examples 14 to 38. Trifluoromethylbenzaldehyde is obtained in an 85% yield. The particularly high concentration of organic halide (approximately 1.5 M) in this example should be noted.

We claim:

1. Process for the electrosynthesis of an aldehyde by the electrolysis, in an electrolytic cell fitted with electrodes, of a reaction mixture comprising an organic halide and an N,N-disubstituted formamide, to form a product after electrolysis having the formula:

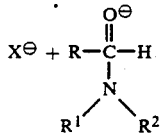

wherein R represents an organic radical; X represents a halogen atom; $R^1$ and $R^2$ which are identical or different, represent a substituted or unsubstituted aliphatic or aromatic chain, or $R^1$ and $R^2$ form a ring, followed by the hydrolysis of said electrolysis product, comprising utilizing an electrolytic cell having a single compartment and a sacrificial anode made of a metal selected from the group consisting of the reducing metals and their alloys.

2. Process according to claim 1, wherein said anode is made of a reducing metal selected from the group consisting of magnesium, aluminium, zinc and their alloys.

3. Process according to claim 1, wherein said aldehyde corresponds to the general formula RCHO in which R denotes an organic radial, said organic halide corresponds to the general formula RX in which R has the abovementioned meaning and X denotes a halogen atom, and said N,N-disubstituted formamide corresponds to the general formula

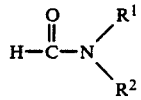

in which $R^1$ and $R^2$, which are identical or different, denote a substituted or unsubstituted aliphatic or aromatic chain or else $R^1$ and $R^2$ form a ring.

4. Process according to claim 3, wherein R denotes a substituted or unsubstituted, aliphatic, arylaliphatic, aromatic, alkylaromatic or heterocyclic organic radical.

5. Process according to claim 1, further comprising the addition of an organic solvent to said reaction mixture.

6. Process according to claim 1, wherein said cell includes a cathode covered with an electrolytic deposit of a metal M selected from the group consisting of zinc, cadmium, lead and tin.

7. Process according to claim 1, further comprising the addition of a cadmium, lead or tin salt to said reaction mixture.

8. Process according to claim 1, wherein the concentration of said organic halide is between 0.05 and 2 mol/l.

9. Process according to claim 1, wherein said organic halide is added progressively to said reaction mixture during electrolysis.

10. Process according to claim 4, wherein R denotes an alkyl radical or phenyl group, substituted or unsubstituted.

11. Process according to claim 2, further comprising the addition of an organic solvent to said reaction mixture.

12. Process according to claim 3, further comprising the addition of an organic solvent to said reaction mixture.

13. Process according to claim 4, further comprising the addition of an organic solvent to said reaction mixture.

14. Process according to claim 2, further comprising the addition of a cadmium, lead or tin salt to said reaction mixture.

15. Process according to claim 3, further comprising the addition of a cadmium, lead or tin salt to said reaction mixture.

16. Process according to claim 4, further comprising the addition of a cadmium, lead or tin salt to said reaction mixture.

17. Process according to claim 5, further comprising the addition of a cadmium, lead or tin salt to said reaction mixture.

18. The process according to claim 1, wherein $R^1$ and $R^2$ represent an alkyl chain containing 1 to 8 carbon atoms or a substituted or unsubstituted phenyl ring.

19. The process according to claim 3, wherein $R^1$ and $R^2$ represent an alkyl chain containing 1 to 8 carbon atoms or a substituted or unsubstituted phenyl ring.

20. The process according to claim 3, wherein said halogen atom is a chlorine atom or a bromine atom.

* * * * *